US010335826B2

(12) United States Patent
Veis et al.

(10) Patent No.: US 10,335,826 B2
(45) Date of Patent: Jul. 2, 2019

(54) APPLYING FLUID TO A SUBSTRATE

(71) Applicant: Hewlett-Packard Industrial Printing Ltd., Netanya (IL)

(72) Inventors: Alex Veis, Kadima (IL); Alex Davidson, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/587,137

(22) Filed: May 4, 2017

(65) Prior Publication Data

US 2017/0232469 A1 Aug. 17, 2017

Related U.S. Application Data

(62) Division of application No. 14/327,368, filed on Jul. 9, 2014, now Pat. No. 9,662,670.

(30) Foreign Application Priority Data

Jul. 19, 2013 (EP) ..... 13177172

(51) Int. Cl.
*B05B 3/00* (2006.01)
*B05B 7/00* (2006.01)
(Continued)

(52) U.S. Cl.
CPC ..... *B05D 1/02* (2013.01); *B05B 3/00* (2013.01); *B05B 7/00* (2013.01); *B05B 12/12* (2013.01); *B05D 1/36* (2013.01); *B41F 3/00* (2013.01); *B41J 2/01* (2013.01); *B41J 2/07* (2013.01); *B41J 2/205* (2013.01); *B41J 2/2114* (2013.01); *B41J 2/2132* (2013.01); *B41J 2/2135* (2013.01); *B41J 2/2146* (2013.01); *B41J 2/515* (2013.01); *B41J 11/0015* (2013.01);
(Continued)

(58) Field of Classification Search
CPC ..... B05D 1/02; B05D 2203/22; B41J 2/01; B41J 3/286; B41J 11/0015
USPC ..... 427/256, 258, 285, 288, 411, 407.1, 427/421.1; 347/1, 2, 4, 9, 12, 13, 19
See application file for complete search history.

(56) References Cited

U.S. PATENT DOCUMENTS 8,465,143 B1 6/2013 Marino et al.
2006/0227157 A1* 10/2006 Drake ..... B41J 2/2146 347/13
(Continued)

FOREIGN PATENT DOCUMENTS

CN 1856611 11/2006
CN 101405142 4/2009
EP 2111994 A2 10/2009
WO WO-2005028731 A1 3/2005

*Primary Examiner* — William P Fletcher, III
(74) *Attorney, Agent, or Firm* — Mannava & Kang

(57) ABSTRACT

According to one example, a method may include determining a desired pattern of fluid to be applied to a substrate, controlling a first array of fluid applicators to apply fluid to the substrate to form a first portion of the pattern, in which an applicator of the first array of fluid applicators spans a section of the substrate that includes portions of the substrate both in and out of the pattern. The method may also include controlling the first array of fluid applicators to cause the applicator to not apply fluid to the section of the substrate and controlling a second fluid applicator to apply fluid to the section of the substrate, the second fluid applicator being separately movable from the first array of fluid applicators.

14 Claims, 4 Drawing Sheets

(51) Int. Cl.

| | |
|---|---|
| ***B05D 1/02*** | (2006.01) |
| ***B05D 1/36*** | (2006.01) |
| ***B41F 3/00*** | (2006.01) |
| ***B41J 2/01*** | (2006.01) |
| ***B41J 2/07*** | (2006.01) |
| ***B41J 2/21*** | (2006.01) |
| ***B41J 3/54*** | (2006.01) |
| ***B05B 12/02*** | (2006.01) |
| ***B05B 12/04*** | (2006.01) |
| ***B05B 12/12*** | (2006.01) |
| ***B41J 11/00*** | (2006.01) |
| ***B41J 2/205*** | (2006.01) |
| ***B41J 2/515*** | (2006.01) |
| ***B41J 29/393*** | (2006.01) |

(52) U.S. Cl.

CPC ..... *B41J 29/393* (2013.01); *B05B 12/02* (2013.01); *B05B 12/04* (2013.01); *B41J 3/543* (2013.01); *B41J 11/008* (2013.01)

(56) References Cited

U.S. PATENT DOCUMENTS

| | | | | |
|---|---|---|---|---|
| 2007/0026213 | A1 | 2/2007 | Craamer | |
| 2007/0146458 | A1 | 6/2007 | Perego | |
| 2009/0262159 | A1* | 10/2009 | Lang ..... | B41J 2/0057 347/15 |
| 2012/0127237 | A1 | 5/2012 | Usuda et al. | |

* cited by examiner

APPLYING FLUID TO A SUBSTRATE

The present application is a Divisional application of commonly assigned and co-pending U.S. Pat. No. 9,662,670, which claims priority to European Patent Application No. 13177172.7, filed Jul. 19, 2013 and entitled "APPLYING FLUID TO A SUBSTRATE," the disclosures of which are hereby incorporated by reference in their entireties.

BACKGROUND

Large quantities of packaging material are produced each year to contain all manner of items. Packaging material is often printed on to provide product related information such as product photos, product specifications, marketing information, and the like. Packaging material, such as corrugated cardboard, is typically transformed into boxes that may be used, for example, for product transport and for product display in retail environments.

To enhance the resistance of printed content on packaging material it is common to apply a varnish or protective overcoat on top of the printed content.

BRIEF DESCRIPTION

Examples, or embodiments of the invention will now be described, by way of non-limiting example only, with reference to the accompanying drawings, in which.

DETAILED DESCRIPTION

Currently the majority of packaging material is printed on using analog printing techniques, such as using flexographic printing plates. Flexographic printing generally enables only relatively low quality images (e.g. in the order of about 80 to 120 lines per inch) to be printed on corrugated packaging material.

Application of varnish to printed content is typically applied using an additional printing plate.

For packaging material intended to be transformed into boxes, the packaging material may be designed to have one or multiple varnish-free zones.

One example of a varnish-free zone is a zone intended to receive adhesive, for example to be used to glue together a packaging box. Many commonly used varnishes adversely affect the properties of adhesives and hence adhesives are generally more effective if applied directly to unvarnished portion of the packing material.

Another example of a varnish-free zone is a zone intended to be later overprinted, for example with a product expiration or manufacturing date. In production lines such overprinting is often performed using inkjet printers and varnishes may adversely affect the properties of inkjet inks.

Accordingly, in current analogue printing techniques a dedicated varnish applicator plate is designed and created with cut-outs corresponding to the designated varnish-free zones. Since analogue printing techniques generally also require the generation of dedicated printing plates, which are generally both costly and time-consuming to produce, analogue printing techniques are generally not suitable for short production runs.

With advances in digital printing technology it is now possible to make high quality (up to 150 DPI or higher) and high speed prints on packaging material, which enables the possibility of both short and long digital printing production runs. However, the application of varnish using conventional analogue techniques is not ideally suited for short production runs, since the generation of custom varnish applicator plates is a costly and time consuming process. Although it is possible to apply varnish using inkjet technology, it is generally a slow process.

Figure 1:
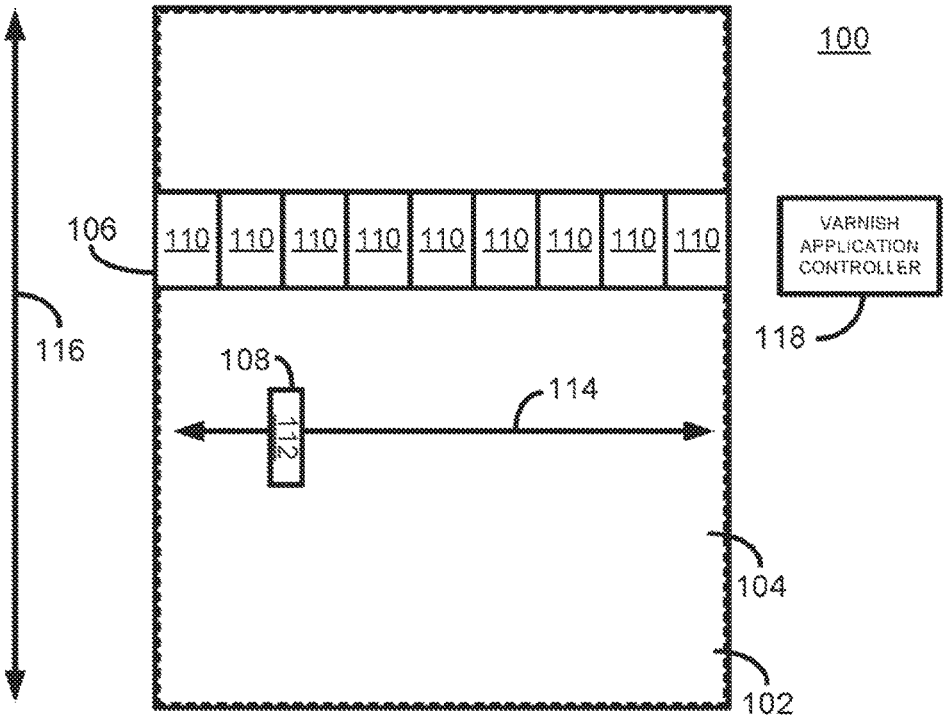
FIG. 1 is a block diagram showing a system for applying fluid to a substrate according to one example.

Referring now to FIG. 1, there is shown a simplified varnish application system 100 according to one example. Although the term 'varnish' is generally used herein, it will be appreciated that the techniques described herein may be suitable for applying any kind of suitable fluid. Accordingly, the term 'varnish' used herein is, where appropriate, also intended to cover any suitable fluid.

The varnish application system 100 comprises a substrate support 102 on which a substrate 104 (shown in dotted line), such as a sheet of packaging material, may be installed. In one example the substrate support 102 is a flat substrate table and may include a substrate securing mechanism (not shown) such as a vacuum hold-down system, mechanical grippers, or the like. A flat substrate table may be used, for example, when rigid or semi-rigid packaging materials are to be processed. In other examples, flexible substrates may be used in which case the substrate support 102 may be in the form of a printer platen, or other suitable configuration.

The varnish application system 100 comprises a first varnish application module 106 and a second varnish application module 108.

The first varnish application module 106 comprises an array of multiple varnish applicators 110. Each varnish applicator 110 is configured to have a predetermined fluid application area over which it may apply varnish to a substrate 104 installed on the substrate support 102. The fluid application area has a pattern that may vary depending on the type of varnish applicator used. For example, a fluid application pattern may include a circular, a rectangular pattern, or other pattern, and a fluid application pattern may be symmetrical or asymmetrical in shape.

In one example each of the varnish applications 110 are individually and selectively controllable to apply or not to apply varnish to a substrate 104 installed on the substrate support 102. In this way, the varnish application module 106 may be configured to apply varnish from a set comprising one or multiple ones of the varnish applicators 110.

In one example, each varnish applicator 110 is configured to apply varnish to a fixed proportion of the width of the substrate support 102. In other examples different ones of the varnish applicators 110 may be configured to apply varnish to different proportions of the width of the substrate 110.

The second varnish application module 108 comprises an array of varnish applicators 112. In the example shown the varnish application module 108 comprises only a single varnish applicator 112, although in other examples the varnish application module 108 may comprise multiple varnish applicators 112. The varnish application module 108 is moveable across the width of the substrate support 102 in an x-axis 114. In one example the varnish application module 108 is mounted on a moveable carriage (not shown) that is moveable along a carriage bar (not shown). In other examples the second varnish application module 108 may be fixed and the substrate support 102 may be arranged to move along the x-axis 114. The fluid application width of the varnish applicator 112 is narrower than the fluid application width of the varnish applicators 110. In one example the fluid application width of the varnish applicator 112 is in the range of about 20 to 50% narrower than the fluid application width of a varnish applicator 110. In other examples other ranges may be used.

In the example shown, the varnish application modules 106 and 108 are fixed in a y-axis 116 and the substrate support 102 is moved in the y-axis 116 under the varnish application modules 106 and 108 to enable varnish to be applied to a substrate 104 installed on the substrate support 102.

In other examples the substrate support 102 may be fixed and the varnish application modules 106 and 108 may be moved in the y-axis 116 to enable apply varnish to be applied to a substrate 104 installed on the substrate support 102.

The varnish application system 100 is generally controlled by a varnish application controller 118. Although not shown in the drawings herein, the system 100 additionally comprises a varnish supply tank and varnish supply system to supply varnish to each of the varnish applicators 110 and 112. In one example the varnish supply system may include one or more pumps or pressurization systems to supply varnish under pressure to each of the varnish applicators 110.

As will be described in greater detail below, the first and second varnish application modules 106 and 108 are used together to apply a desired pattern of varnish, or other suitable fluid, to a substrate installed on the substrate support 102. The first varnish application module 106 is used to quickly apply varnish in pattern that approaches the desired pattern of varnish. Due to the modular nature of the varnish application module 106, it will be appreciated that the first varnish application module 106 is only able to apply varnish to discrete portions of a substrate. The second varnish application module 108, which is able to apply varnish to any portion of a substrate, is then used to apply varnish to those areas which the first varnish application module 106 is not able to apply varnish to.

Although applying varnish using the second varnish application module 108 is slower than applying varnish using the first varnish application module 106, the use of both first and second varnish application modules enables highly efficient and fast application of varnish in any desired varnish pattern.

Example operation of the varnish application system 100 will now be described with additional reference to FIGS. 2 and 3.

Figure 2:
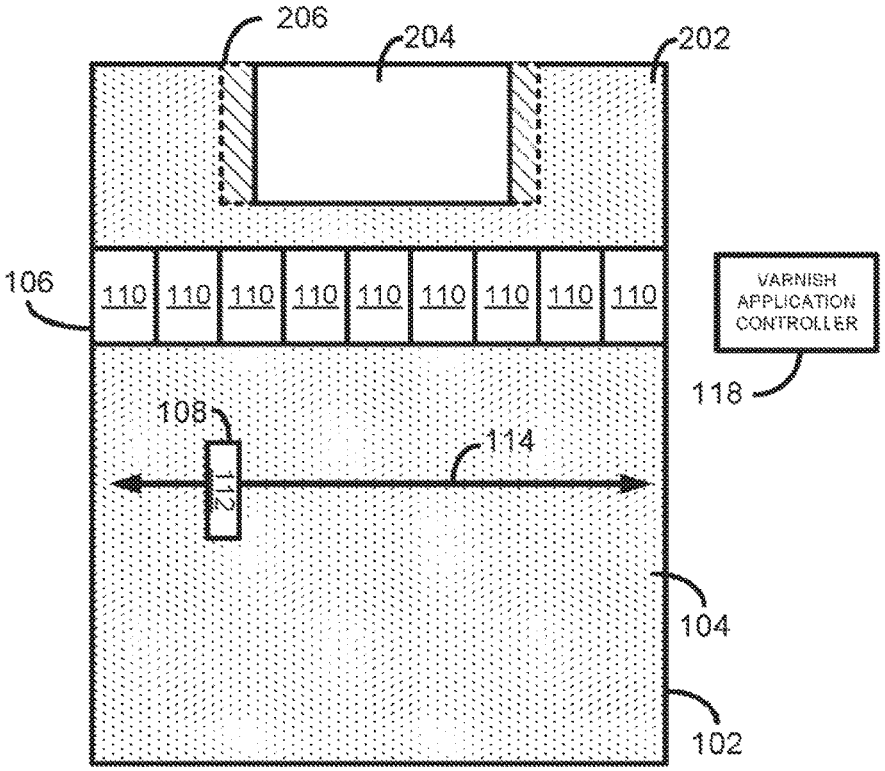
FIG. 2 is a block diagram showing a system for applying fluid to a substrate according to a one example.
Figure 3:
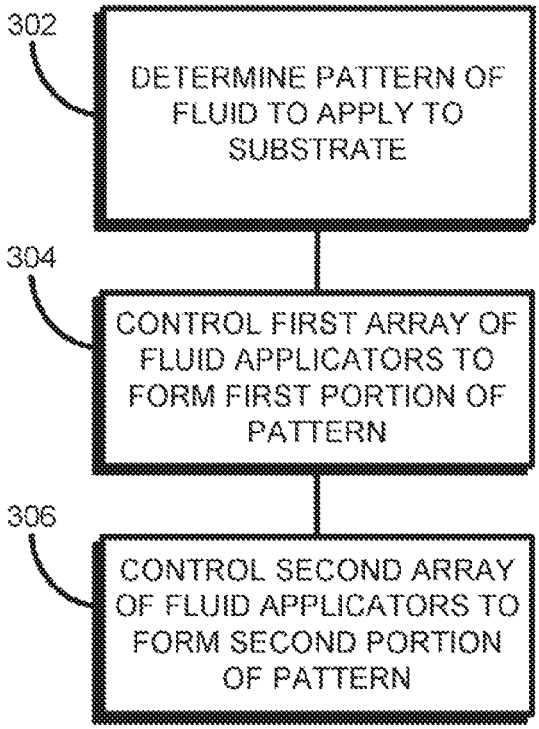
FIG. 3 is a flow diagram outlining a method of operating a system for applying fluid to a substrate according to a one example.

FIG. 2 shows a desired pattern 202 of varnish, or other fluid, to be applied by the varnish application system 100 to a substrate 104. The pattern 202 comprises a desired varnish-free zone 204 to be left free of varnish. Although in this example only a single varnish-free zone is shown in other examples a desired pattern of varnish may include multiple varnish-free zones.

At block 302 the varnish application controller 118 determines a pattern of fluid, such as varnish, that is to be applied to a substrate. The pattern may be obtained, for example, in the form of an image file such as bitmap or vector graphic image format. The pattern may, for example, be included as a separate layer of an image file comprising multiple colour separation layers.

At block 304 the varnish application controller 118 controls the first array of varnish applicators 110, as well as relative movement between the substrate 104 and the varnish applicator 106, to form a first portion of the desired varnish pattern 202 on the substrate 104. In one example the first portion of the desired varnish pattern is formed in just a single pass of relative movement between the first varnish applicator 106 and the substrate 104.

The first portion of the pattern is that portion of the desired pattern that may be applied using the first varnish application module 106. Since each of the individual varnish applicators 110 can only apply varnish to a discrete fixed width portion of a substrate, depending on the width of the desired varnish free-zone 204 it may not be possible to completely form the desired varnish pattern. Thus, the varnish application controller 118 selects which of the individual varnish applicators 110 are to be used to generate the first portion of the pattern, such that the varnish-free zone of the first portion of the pattern is at least no smaller than the desired varnish-free zone.

An example is shown in FIG. 2 where a desired varnish pattern 202 covers the substrate 104 except for a varnish-free zone 204. If only the two individual varnish applicators 110 at each extremity of the varnish application module 106 are selected to be used it can be seen that it is possible to form a varnish pattern having a varnish-free zone which exceeds the dimensions of the desired varnish-free zone 204 by the dimensions of a zone 206. It can also be seen that is the three individual varnish applicators 110 at each extremity of the varnish application module 106 were selected that this would lead to the varnish-free zone being smaller than the desired varnish-free zone 204.

At block 306 the varnish application controller 118 controls the second array of varnish applicators 112, as well as relative movement in both the x-axis 114 and the y-axis 116 (as appropriate) between the substrate 104 and the varnish application module 106, to form a second, or remainder, portion 206 of the desired varnish pattern 202 on the substrate. The second portion 206 represents a difference pattern corresponding to the difference between the desired fluid pattern and the fluid pattern to be applied by the first fluid application module 106.

The second portion 206 of the desired varnish pattern 202 will typically represent only a fraction of the whole varnish pattern 202, and thus may be formed relatively quickly using the second varnish application module 108. Depending on its fluid application width the second varnish application module 108 may apply varnish during one or multiple passes of relative movement between the varnish applicator 108 and the substrate 104 may be necessary.

In one example the second varnish application module 108 may apply varnish to a portion of a substrate whilst the first varnish application module 106 is applying varnish to another portion of the substrate. In another example the second varnish application module 108 may apply varnish to a substrate only once the first varnish application module 108 has applied varnish to the substrate.

In one example the varnish applicators 110 are spray nozzles. In another example the varnish applicators 110 are varnish applying rollers. In other examples other suitable varnish applicators may be used.

In one example the varnish applicators 112 are spray nozzles. In another example the varnish applicators 112 are varnish apply rollers. In other examples other suitable varnish applicators may be used.

In one example each varnish applicator 110 and 112 may be controlled using an electromechanical valve to control the supply of pressurized varnish to the spray nozzles.

In one example the varnish applicators 110 are fixed width spray nozzles and the varnish applicators 112 are variable width spray nozzles.

Figure 4:
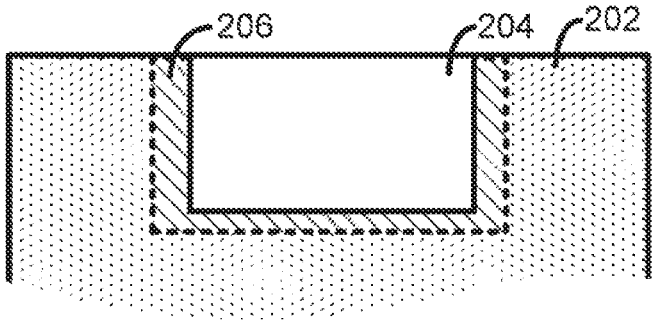
FIG. 4 is a diagram illustrating a varnish pattern to be formed on a substrate according to one example.

Depending on the accuracy at which each of the varnish applicators 110 may be operated, for example the speed at which they may be activated and deactivated, the varnish-free portion formed by the first varnish application module 106 may extend beyond the desired varnish-free zone 204 in both the x (114) and y (116) axis, as shown in FIG. 4. If this is the case, varnish controller 118 controls the second varnish application module 108 to apply varnish to the zone 206 in the manner described above.

Whatever kind of varnish applicators 110 and 112 are used they should be suitable for applying a substantially uniform thickness layer of varnish. Furthermore, there should be no discernible differences in the thickness of varnish layers formed using either the first varnish application module 106 or the second varnish application module 108.

Figure 5:
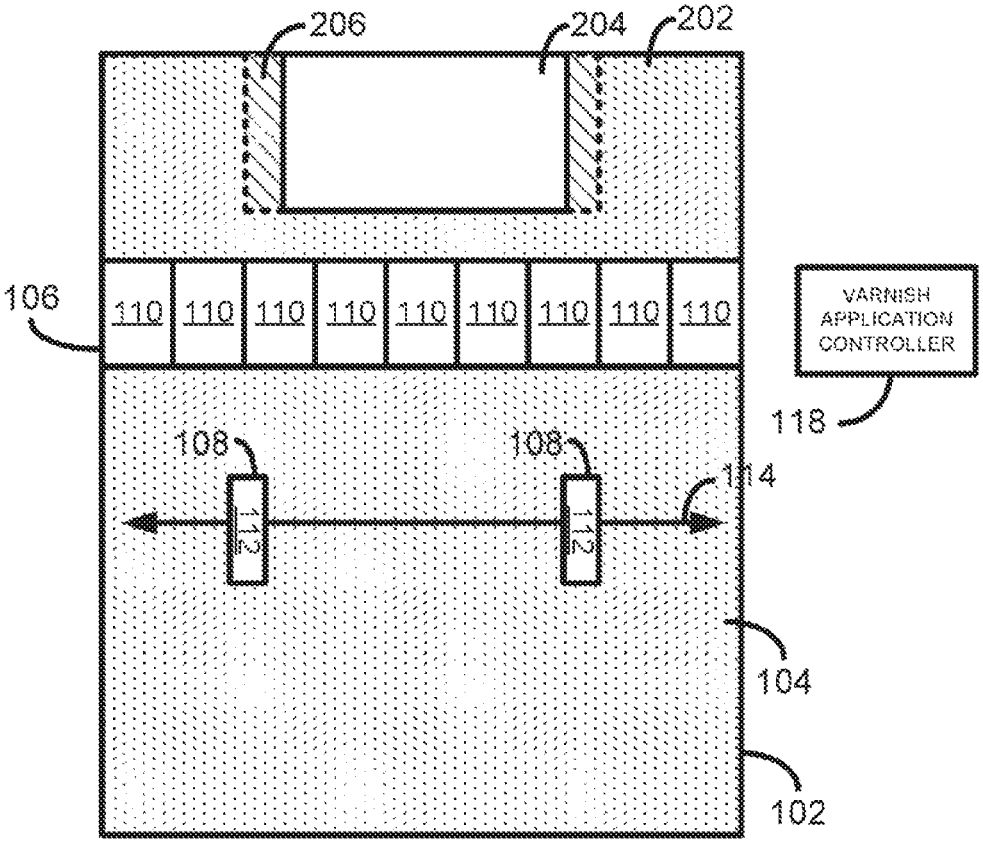
FIG. 5 is a block diagram showing a system for applying fluid to a substrate according to one example.

In a further example, as illustrated in FIG. 5, the second varnish application module 108 may comprise two arrays of varnish applicators 112, each moveable relative to each other along the x-axis 114. In this example, the varnish application controller 118 may control the position of each array of varnish applicators 112 so that each applies varnish to different lateral extremities of second portion 206 of the desired varnish pattern 202 on the substrate. In this way, the time for applying varnish to the second portion 206 may be cut in half compared to the varnish application system shown in FIG. 1.

In a further example the distance between the varnish application module 108 and the substrate support 102 may be varied to vary the size of the area to which each varnish applicator 112 may apply varnish.

In a further example, each varnish applicator 112 may be electro-mechanically rotatable, in the case where a spray pattern generated by a varnish applicator is non-circular, to best adjust a spray pattern for efficient application of varnish to a substrate.

In a yet further example, each varnish applicator 112 may have an electro-mechanically modifiable spray pattern or spray size that may be adjusted by the varnish application controller 118 to best adjust a spray pattern for efficient application of varnish to a substrate.

In one example the varnish application module 108 may be mounted on a robotic arm, for example and be controllable in the x, y, and z-axes.

In general it will be appreciated that the application of varnish to a substrate to generate a varnish-free zone does not have to be performed with a high degree of accuracy. For example, in many situations an accuracy of +/− 1 mm may be acceptable.

Figure 6:
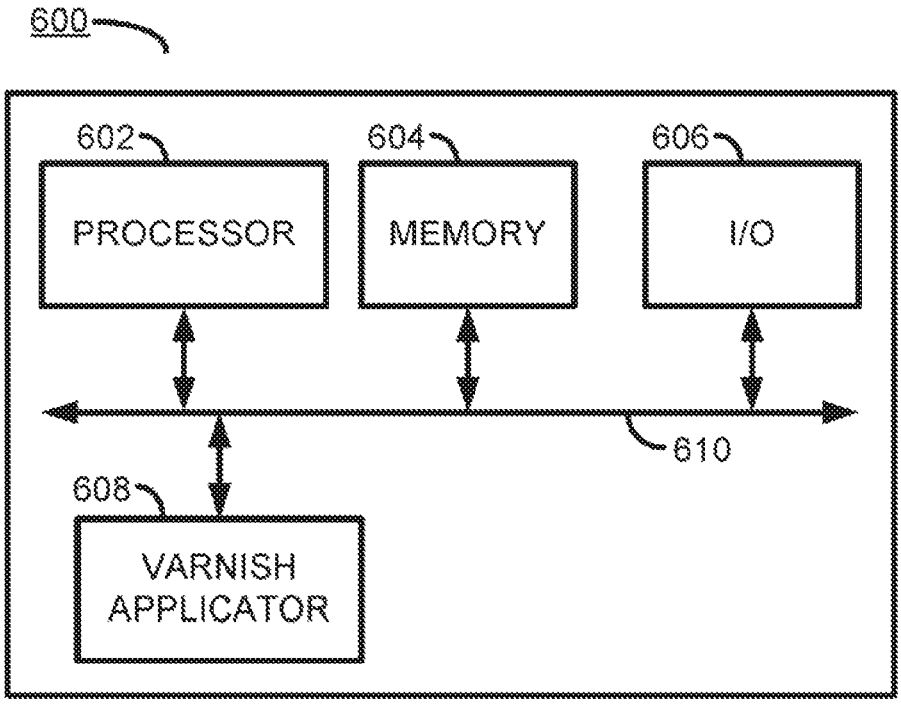
FIG. 6 is a block diagram of a varnish application system according to one example.

FIG. 6 is an example block diagram of a varnish application system 600 according to one example. The varnish application system 600 comprises a processor 602, a memory 604, an input/output (I/O) module 606, and a varnish application module, all coupled together on bus 610. In some examples the varnish application system 600 may also have a user interface module, an input device, and the like, but these items are not shown for clarity. The processor 602 may comprise a central processing unit (CPU), a microprocessor, an application specific integrated circuit (ASIC), or a combination of these devices. The memory 604 may comprise volatile memory, non-volatile memory, and a storage device. The memory 604 is a non-transitory computer readable medium. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical drives, and flash memory devices.

The I/O module 606 may be used, for example, to couple the varnish application system to other devices, for example the Internet or a computer. The varnish application system 600 has code, typically called firmware, stored in the memory 604. The firmware is stored as computer readable instructions in the non-transitory computer readable medium (i.e. the memory 604). The processor 602 generally retrieves and executes the instructions stored in the non-transitory computer-readable medium to operate the varnish application system and to execute functions. In one example, processor executes code that causes varnish to be applied to a substrate, as described herein.

Figure 7:
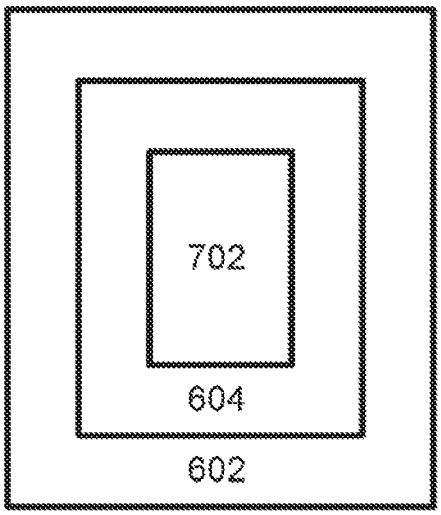
FIG. 7 is a block diagram of a processor coupled to a memory according to one example.

FIG. 7 is an example block diagram of the processor 602 coupled to memory 604. Memory 604 contains software 702 (also known as firmware). The software 702 contains a varnish application control module that when executed by the processor 602 causes the varnish application system 600 to apply varnish to a substrate as described herein.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method of applying fluid in a desired pattern to a substrate, comprising:

determining the desired pattern of fluid to be applied to the substrate;

controlling a first array of fluid applicators that extends across a width of a path of the substrate to apply fluid to the substrate to form a first portion of the pattern, wherein an applicator of the first array of fluid applicators spans a section of the substrate that includes portions of the substrate both in and out of the pattern, and wherein the controlling includes controlling the first array of fluid applicators to cause the applicator to not apply fluid to the section of the substrate; and controlling a second fluid applicator to apply fluid to the portions of the substrate that the applicator of the first array of fluid applicators was not controlled to apply fluid during application of the fluid to form the first portion of the pattern, the second fluid applicator being separately movable from the first array of fluid applicators.

2. The method of claim 1, further comprising:

determining a difference pattern corresponding to the portions of the substrate both in and out of the pattern, and controlling the second fluid applicator to apply fluid to the substrate at the determined difference pattern.

3. The method of claim 1, further comprising determining a set of fluid applicators in the first array to use in applying the first portion of the pattern of fluid.

4. The method of claim 1, wherein controlling the second fluid applicator to apply fluid to the portions of the substrate that the applicator of the first array of fluid applicators was not controlled to apply fluid during application of the fluid to form the first portion of the pattern further comprises controlling each of the second fluid applicator and another second fluid applicator to apply fluid to different lateral extremities of a second portion of the pattern that the applicator of the first array of fluid applicators was not controlled to apply fluid to the section of the substrate.

5. The method of claim 4, further comprising controlling the first array of fluid applicators to apply fluid to form the first portion of the pattern on the substrate whilst controlling the second fluid applicator and the other second fluid applicator to apply fluid to form the second portion of the pattern on the substrate.

6. The method of claim 1, wherein controlling the second fluid applicator to apply fluid to the portions of the substrate that the applicator of the first array of fluid applicators was not controlled to apply fluid during application of the fluid to form the first portion of the pattern further comprises controlling the second fluid applicator to apply fluid to form the portions of the pattern to not overlap with the first portion of the pattern of fluid.

7. The method of claim 1, further comprising:

moving the substrate relative to the first array of fluid applicators in a first axis during application of the first portion of the pattern of fluid to the substrate while maintaining the first array of fluid applicators stationary.

8. The method of claim 7, further comprising:

moving the second fluid applicator in a second axis that is perpendicular to the first axis to apply the second portion of the pattern to the substrate.

9. A method of applying fluid to a substrate, said method comprising:

determining a pattern of fluid to apply to the substrate;

controlling a first array of fluid applicators to apply fluid to the substrate to form a first portion of the pattern, wherein the first array of fluid applicators are arranged in a line across a width of a path for the substrate, each applicator in the first array of fluid applicators is positioned to apply fluid to a set portion of a width of the substrate, and wherein, when a fluid applicator in the first array of fluid applicators spans a width of the substrate that includes portions of the substrate both in and out of the pattern, the fluid applicator is not used to apply fluid for the first portion of the pattern; and controlling a second fluid applicator to apply fluid to the substrate at those portions in the pattern not covered by the fluid applicator in the first array of fluid applicators to form a second portion of the pattern and complete the pattern.

10. The method of claim 9, further comprising:

moving the substrate relative to the first array of fluid applicators in a first axis; and moving the second fluid applicator in a second axis that is orthogonal to the first axis at least one of prior to and during application of the fluid by the second fluid applicator to the substrate.

11. The method of claim 9, further comprising determining a set of fluid applicators in the first array to use in applying the first portion of the pattern of fluid.

12. The method of claim 9, further comprising controlling each of the second fluid applicator and another second fluid applicator to apply fluid to different lateral extremities of the second portion of the pattern.

13. The method of claim 12, further comprising moving each of the second fluid applicator and the other second fluid applicator relative to each other.

14. The method of claim 9, further comprising controlling the second fluid applicator to apply the second portion of the pattern of fluid to not overlap with the first portion of the pattern of fluid.

* * * * *